US010954909B2

(12) United States Patent
Ono et al.

(10) Patent No.: US 10,954,909 B2
(45) Date of Patent: Mar. 23, 2021

(54) ELECTROMAGNETIC SWITCH DEVICE FOR STARTER

(71) Applicant: Mitsubishi Electric Corporation, Tokyo (JP)

(72) Inventors: Takuma Ono, Tokyo (JP); Yoshihiro Morimoto, Tokyo (JP); Tasuku Ito, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 180 days.

(21) Appl. No.: 16/332,059

(22) PCT Filed: Oct. 5, 2016

(86) PCT No.: PCT/JP2016/079648
§ 371 (c)(1),
(2) Date: Mar. 11, 2019

(87) PCT Pub. No.: WO2018/066090
PCT Pub. Date: Apr. 12, 2018

(65) Prior Publication Data

US 2019/0219017 A1 Jul. 18, 2019

(51) Int. Cl.
*H01H 50/54* (2006.01)
*F02N 11/08* (2006.01)
(Continued)

(52) U.S. Cl.
CPC ..... *F02N 11/087* (2013.01); *F02N 11/00* (2013.01); *F02N 11/08* (2013.01); *F02N 15/067* (2013.01);
(Continued)

(58) Field of Classification Search
CPC ..... F02N 11/00; F02N 11/08; F02N 11/087; F02N 11/0851; F02N 11/0892;
(Continued)

(56) References Cited

U.S. PATENT DOCUMENTS 4,731,543 A * 3/1988 Buetemeister ..... F02N 11/087 290/38 R
5,159,908 A * 11/1992 Eyermann ..... F02N 15/067 123/179.1
(Continued)

FOREIGN PATENT DOCUMENTS

GB 1 418 396 12/1975
JP 2001-508855 A 7/2001

OTHER PUBLICATIONS

International Search Report for PCT/JP2016/079648, dated Nov. 8, 2016.

*Primary Examiner* — Shawki S Ismail
*Assistant Examiner* — Lisa N Homza
(74) *Attorney, Agent, or Firm* — Sughrue Mion, PLLC; Richard C. Turner

(57) ABSTRACT

A movable iron core, a primary attracting and holding coil, a resistor electrically connected to an upstream start-up electric contact, and an auxiliary attracting and holding coil electrically connected to the upstream start-up electric contact are included. The movable iron core displaces a pinion from a separated position to a contact position. After the pinion is displaced from the separated position to the contact position, the upstream start-up electric contact is electrically disconnected from another start-up electric contact to cut off a current to the motor, and the movable iron core displaces the pinion from the contact position to an engaged position with the magnetomotive force of the primary attracting and holding coil and a magnetomotive force of the auxiliary attracting and holding coil. After the pinion is displaced from the contact position to the engaged position, main electric contacts are electrically connected to resume electric connection to the motor.

4 Claims, 6 Drawing Sheets

(51) Int. Cl.

| | |
|---|---|
| ***H01H 51/06*** | (2006.01) |
| ***F02N 15/06*** | (2006.01) |
| ***H01H 47/22*** | (2006.01) |
| ***H01H 50/44*** | (2006.01) |
| ***F02N 11/00*** | (2006.01) |
| *F02N 15/00* | (2006.01) |

(52) U.S. Cl.
CPC ..... *H01H 47/22* (2013.01); *H01H 50/443* (2013.01); *H01H 50/543* (2013.01); *H01H 51/065* (2013.01); *F02N 11/0851* (2013.01); *F02N 15/006* (2013.01); *F02N 2011/0892* (2013.01)

(58) Field of Classification Search
CPC ..... F02N 15/006; F02N 15/067; H01H 47/22; H01H 50/443; H01H 50/543; H01H 51/065
USPC ..... 335/2
See application file for complete search history.

(56) References Cited

U.S. PATENT DOCUMENTS 5,656,981 A * 8/1997 Niimi ..... F02N 11/087 335/126
5,892,421 A * 4/1999 Matsushima ..... F02N 11/00 290/38 R
6,050,233 A * 4/2000 Vilou ..... F02N 11/087 123/179.3
6,360,707 B1 3/2002 Boegner
6,863,041 B2 * 3/2005 Nagai ..... F02N 11/0851 123/179.25
6,938,599 B2 * 9/2005 Senda ..... F02N 11/087 123/179.3
7,034,643 B1 * 4/2006 Kusumoto ..... F02N 15/067 335/126
7,038,564 B1 * 5/2006 Kusumoto ..... F02N 11/00 335/126
7,948,338 B2 * 5/2011 Niimi ..... F02N 15/067 335/126
7,996,135 B2 * 8/2011 Ishii ..... F02N 11/0855 701/54
8,299,639 B2 * 10/2012 Usami ..... F02N 15/067 290/38 R
8,305,169 B2 * 11/2012 Suzuki ..... F02N 11/087 335/126
8,492,916 B2 * 7/2013 Murata ..... F02N 11/087 290/38 R
8,513,825 B2 * 8/2013 Suzuki ..... F02N 11/087 290/38 R
8,847,713 B2 * 9/2014 Niimi ..... H01H 50/443 335/126
9,121,382 B2 * 9/2015 Yamada ..... F02N 11/087
9,353,720 B2 * 5/2016 Hirabayashi ..... F02N 11/0851
9,938,950 B2 * 4/2018 Okada ..... H02K 3/12
10,147,575 B2 * 12/2018 Suzuki ..... H01H 51/065
2009/0206965 A1 * 8/2009 Niimi ..... H01H 50/54 335/106
2018/0003141 A1 * 1/2018 Morimoto ..... F02N 11/0851
2018/0005790 A1 * 1/2018 Morimoto ..... H01H 50/14
2019/0017485 A1 * 1/2019 Morimoto ..... H01H 50/54
2020/0312596 A1 * 10/2020 Ono ..... F02N 15/067

* cited by examiner

ELECTROMAGNETIC SWITCH DEVICE FOR STARTER

TECHNICAL FIELD

This Application is a National Stage of International Application No. PCT/JP2016/079648 filed Oct. 5, 2016.

The present invention relates to an electromagnetic device for a starter, for use in a starter to start an engine installed in an automobile or the like.

BACKGROUND ART

There has been known an electromagnetic switch device for a starter in which a pinion is pushed toward a ring gear, by displacing a movable iron core with the use of a magnetomotive force generated in a coil, to be engaged with the ring gear while the pinion is rotated slowly, and, after the pinion is engaged with the ring gear, a motor is rotated by switching from a start-up electric circuit to a main electric circuit as an electric circuit for allowing a current to flow into the motor, with the use of a changeover contact interlocked with the displacement of the movable iron core. (see Patent Literature 1, for example).

CITATION LIST

Patent Literature

[PTL 1] JP 2001-508855 A1

SUMMARY OF INVENTION

Technical Problem

The pinion, however, is moved toward the ring gear by the magnetomotive force generated in the coil, and an impact force from an impact between an end face of the pinion and an end face of the ring gear hastens the wearing of the ring gear. The resultant problem is that the pinion and the ring gear engage poorly with each other. A possible solution is to reduce the magnetomotive force generated in the coil while electric connection to the start-up electric circuit is established, for the purpose of decreasing the wearing of the ring gear, by lessening the impact force generated when the pinion reaches the ring gear. However, the reduction of the magnetomotive force during the engagement operation also reduces the magnetomotive force at the time of switching of the motor's electric circuit. This gives rise to another problem in that the coil cannot generate a magnetomotive force large enough to overcome a return spring, which is included in the changeover contact.

It is an object of the present invention to provide an electromagnetic switch device for a starter capable of decreasing the wearing of a ring gear.

Solution to Problem

According to one embodiment of the present invention, there is provided an electromagnetic switch device for a starter including: a pair of main electric contacts included in a main electric circuit to determine whether to open or close the main electric circuit depending on electric connection/disconnection between the pair of main electric contacts, the main electric circuit being configured to allow a current to flow from a battery to a motor; a pair of start-up electric contacts included in a start-up electric circuit to determine whether to open or close the start-up electric circuit depending on electric connection/disconnection between the pair of start-up electric contacts, the start-up electric circuit being configured to allow a current to flow from the battery to the motor; a movable iron core configured to displace a pinion of a starter between a separated position, at which the pinion is apart from a ring gear of an engine, and a contact position, at which the pinion is brought into contact with the ring gear, and between the contact position and an engaged position, at which the pinion is engaged with the ring gear; a primary attracting and holding coil provided around the movable iron core and configured to generate a magnetomotive force; a resistor provided to create a branch upstream of the primary attracting and holding coil, and electrically connected to one of the pair of start-up electric contacts; and an auxiliary attracting and holding coil, which is electrically connected to the one of the pair of start-up electric contacts, provided around the movable iron core coaxially with the primary attracting and holding coil, and is configured to generate a magnetomotive force, wherein the pinion is displaced from the separated position to the contact position with the movable iron core and with the magnetomotive force of the primary attracting and holding coil in response to a start-up signal, and a current flowing in the resistor generates a start-up rotational force in the motor, wherein, after the pinion is displaced from the separated position to the contact position, the start-up electric contacts are electrically disconnected to cut off the current to the motor, and the pinion is displaced from the contact position to the engaged position with the movable iron core and with the magnetomotive force of the primary attracting and holding coil and the magnetomotive force of the auxiliary attracting and holding coil, and wherein, after the pinion is displaced from the contact position to the engaged position, the main electric contacts are electrically connected to resume electric connection to the motor, which generates a main rotational force to the motor, and the pinion is kept at the engaged position with the movable iron core and with the magnetomotive force of the primary attracting and holding coil and the magnetomotive force of the auxiliary attracting and holding coil.

Advantageous Effects of Invention

According to the electromagnetic switch device for a starter of the present invention, the primary attracting and holding coil and the auxiliary attracting and holding coil, each of which generates a magnetomotive force, are provided thereto, and the magnetomotive force, which is to be generated when the start-up electric circuit is energized, can be made small, thereby being capable of decreasing the wearing of the ring gear.

DESCRIPTION OF EMBODIMENTS

First Embodiment

Figure 1:
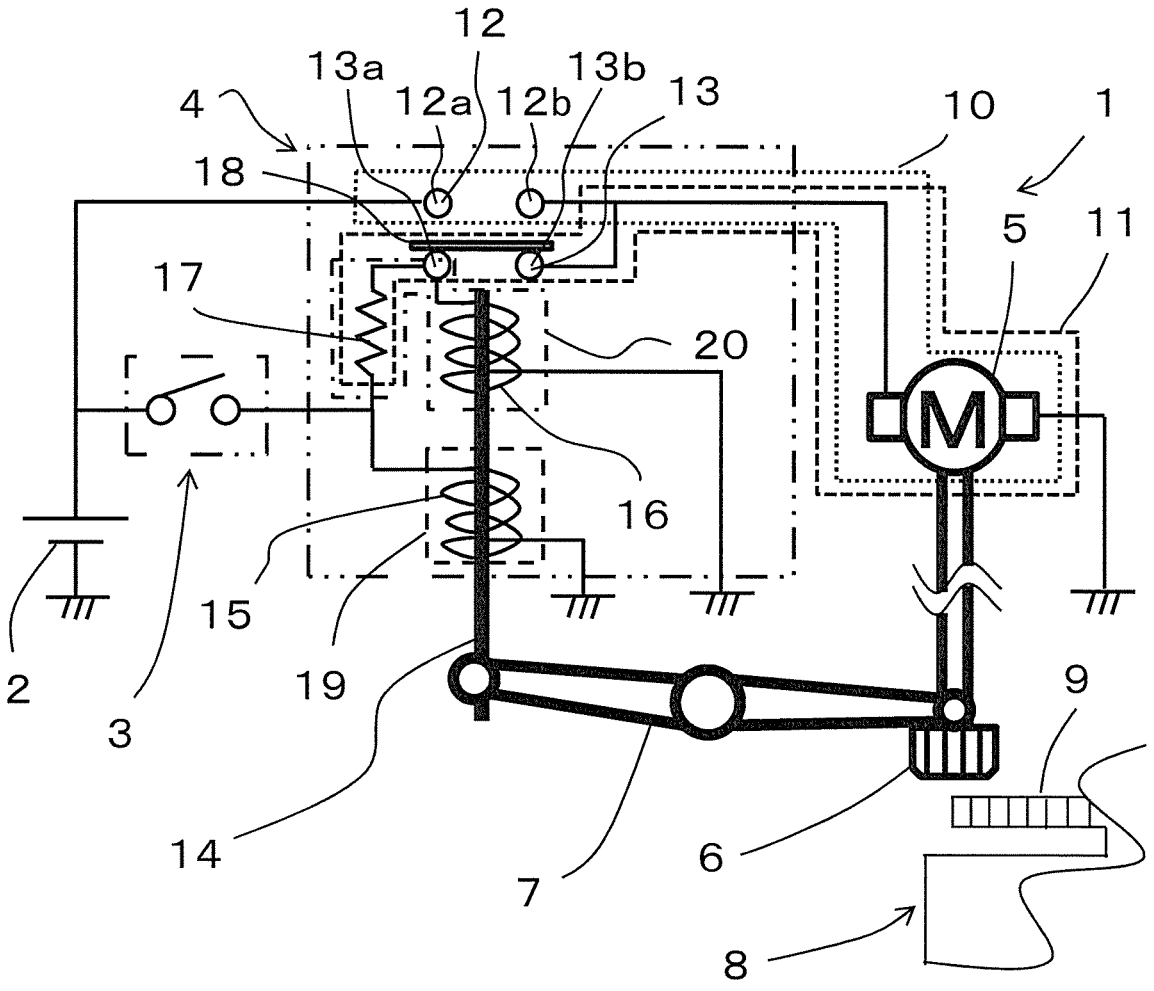
FIG. 1 is a diagram for illustrating a starter of a first embodiment of the present invention.

FIG. 1 is a diagram for illustrating a starter of a first embodiment of the present invention. A starter 1 of the first embodiment of the present invention includes an auxiliary relay 3, which is electrically connected to a battery 2, an electromagnetic switch device 4 for a starter, which is electrically connected to the battery 2 and the auxiliary relay 3, a motor 5, to which a current is supplied from the electromagnetic switch device 4 for a starter, a pinion 6, which is rotated by driving the motor 5, and a lever 7, which is displaced to displace the pinion 6. The pinion 6 is displaced between a separated position at which the pinion 6 is apart from a ring gear 9 of an engine 8 and a contact position at which the pinion 6 is brought into contact with the ring gear 9. The pinion 6 is also displaced between the contact position and an engaged position at which the pinion 6 is engaged with the ring gear 9. The pinion 6 is coupled to the lever 5. The pinion 6 is displaced between the separated position and the contact position, and between the contact position and the engaged position by displacing the lever 7.

The auxiliary relay 3 switches the action of the electromagnetic switch device 4 for a starter. The auxiliary relay 3 is closed by a start-up signal. A current is supplied to the electromagnetic switch device 4 for a starter from the battery 2 via the auxiliary relay 3 by closing the auxiliary relay 3. In contrast, the supply of the current to the electromagnetic switch device 4 for a starter from the battery 2 via the auxiliary relay 3 is stopped by opening the auxiliary relay 3.

The electromagnetic switch device 4 for a starter is configured to displace the pinion 6 via the lever 7, and switch between a main electric circuit 10 and a start-up electric circuit 11 as an electric circuit for allowing a current to flow into the motor 5.

The motor 5 uses a current supplied from the battery 2 to generate a rotational force with which the ring gear 9 of the engine 8 is rotated via the pinion 6.

The main electric circuit 10 configured to allow a current to flow from the battery 2 into the motor 5 when the motor 5 is in normal operation. The main electric circuit 10 includes a pair of main electric contacts 12, electric connection/disconnection between which determines whether the main electric circuit 10 is opened or closed. The pair of main electric contacts 12 is opened when the motor 5 and the starter 1 are not in action. In this example, one of the pair of main electric contacts 12 is referred to as "upstream main electric contact 12*a*" and the other of the pair of main electric contacts 12 is referred to as "downstream main electric contact 12*b*". The upstream main electric contact 12*a* is placed upstream of the downstream main electric contact 12*b*. "Upstream" in this example means an area of an electric circuit that is close to the battery 2.

The start-up electric circuit 11 is configured to allow a current to flow from the battery 2 into the motor 5 in start-up operation. The start-up electric circuit 11 includes a pair of start-up electric contacts 13, electric connection/disconnection between which determines whether the start-up electric circuit 11 is opened or closed. The pair of start-up electric contacts 13 is closed when the starter 1 is not in action and during the start-up operation of the motor 5. In this example, one of the pair of start-up electric contacts 13 is referred to as "upstream start-up electric contact 13*a*" and the other of the pair of start-up electric contacts 13 is referred to as "downstream start-up electric contact 13*b*". The upstream start-up electric contact 13*a* is placed upstream of the downstream start-up electric contact 13*b*.

The electromagnetic switch device 4 for a starter includes a movable iron core 14, a primary attracting and holding coil 15, an auxiliary attracting and holding coil 16, a resistor 17, and a movable contact 18. The movable iron core 14 is displaced to displace the lever 7, which in turn displaces the pinion 6. The primary attracting and holding coil 15 is provided around the movable iron core 14. The auxiliary attracting and holding coil 16 is provided around the movable iron core 14 coaxially with the primary attracting and holding coil 15. The resistor 17 is provided to create a branch upstream of the primary attracting and holding coil 15, and is electrically connected to the start-up electric contact 13*a*, which is one of the pair of start-up electric contacts 13. The movable contact 18 is displaced with the displacement of the movable iron core 14.

A current flow in the primary attracting and holding coil 15 generates a magnetomotive force in the primary attracting and holding coil 15 as a force with which the movable iron core 14 is displaced. A current flow in the auxiliary attracting and holding coil 16 generates a magnetomotive force in the auxiliary attracting and holding coil 16.

The primary attracting and holding coil 15 makes up a primary attracting and holding circuit 19. The resistor 17, the upstream start-up electric contact 13*a*, and the auxiliary attracting and holding coil 16 make up a auxiliary attracting and holding circuit 20. The resistor 17 is included in the start-up electric circuit 11 as well.

An electric circuit of the starter 1 is made up of the main electric circuit 10, the start-up electric circuit 11, the primary attracting and holding circuit 19, and the auxiliary attracting and holding circuit 20.

An electric circuit of the electromagnetic switch device 4 for a starter is made up of a part of the electric circuit of the starter 1 excluding the auxiliary relay 3 and the motor 5. The auxiliary relay 3 may be included in the electric circuit of the electromagnetic switch device 4 for a starter.

Figure 2:
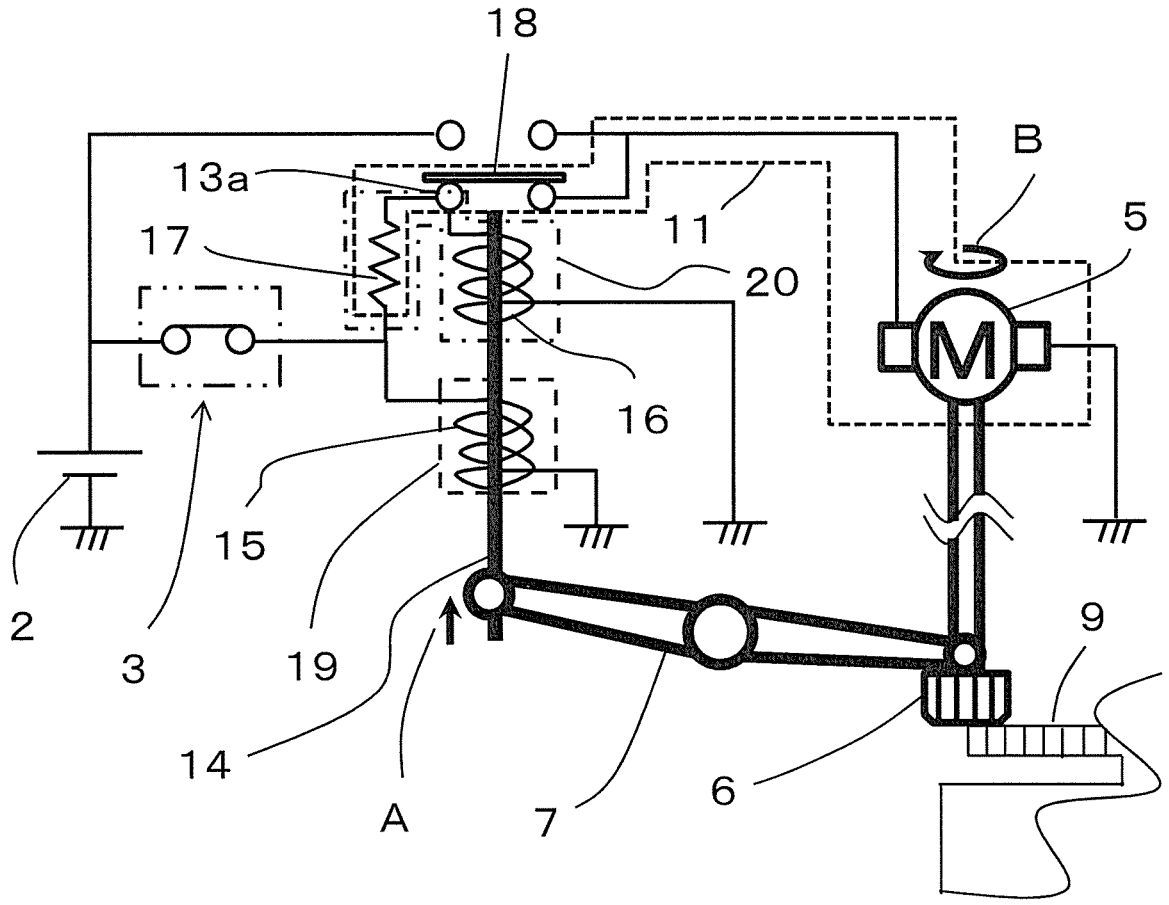
FIG. 2 is an explanatory diagram of a first operation stage in the starter of FIG. 1.

Next, the operation of the starter 1 is described. A description is given first on a first operation stage in which the pinion 6 is displaced from the separated position to the contact position, and is rotated to a position where a tooth of one of the pinion 6 and the ring gear 9 falls into place between teeth of the other of the pinion 6 and the ring gear 9. FIG. 2 is an explanatory diagram of the first operation stage in the starter 1 of FIG. 1. The auxiliary relay 3 is switched on in response to a start-up request. This triggers a supply of current from the battery 2 to the primary attracting and holding circuit 19 and the auxiliary attracting and holding circuit 20. A current is also supplied to the motor 5 from the battery 2 via the start-up electric circuit 11 because the pair of start-up electric contacts 13 is closed by the movable contact 18.

The current flowing in the primary attracting and holding circuit 19 generates a magnetomotive force in the primary attracting and holding coil 15. This generates a start-up attractive force A with which the movable iron core 14 is moved slowly toward the movable contact 18.

The auxiliary attracting and holding coil 16 of the auxiliary attracting and holding circuit 20 is connected in parallel to the motor 5 of the start-up electric circuit 11 and, because the auxiliary attracting and holding coil 16 is much higher in resistance value than the motor 5, most of a current passing through the upstream start-up electric contact 13*a* flows into the motor 5. This generates a start-up rotational force B for slowly turning the pinion 6. The start-up rotational force B is adjusted with the use of the resistance value of the resistor 17.

Part of the current passing through the upstream start-up electric contact 13*a* flows into the auxiliary attracting and holding coil 16 to generate a minute magnetomotive force in the auxiliary attracting and holding coil 16. However, the magnetomotive force generated in the auxiliary attracting and holding coil 16 is minute compared to the magnetomotive force of the primary attracting and holding coil 15, and accordingly contributes little to the start-up attractive force A.

The start-up attractive force A moves the pinion 6 slowly via the lever 7 engaged with the movable core 14, from the separated position to the contact position toward an end face of the ring gear 9. In this case, the magnetomotive force of the auxiliary attracting and holding coil 16 hardly contributes to the start-up attractive force A, and an impact force generated between the pinion 6 and the ring gear 9 is therefore smaller than when the magnetomotive force of the auxiliary attracting and holding coil 16 contributes to the start-up attractive force A. In this manner, the wearing of the ring gear 9 is decreased.

While end faces of the pinion 6 and the ring gear 9 are brought into contact with each other after the pinion 6 bumps into the ring gear 9, the pinion 6 cannot be displaced from the contact position to the engaged position. The start-up rotational force B, however, allows the pinion 6 to loosely fit with the ring gear 9.

Figure 3:
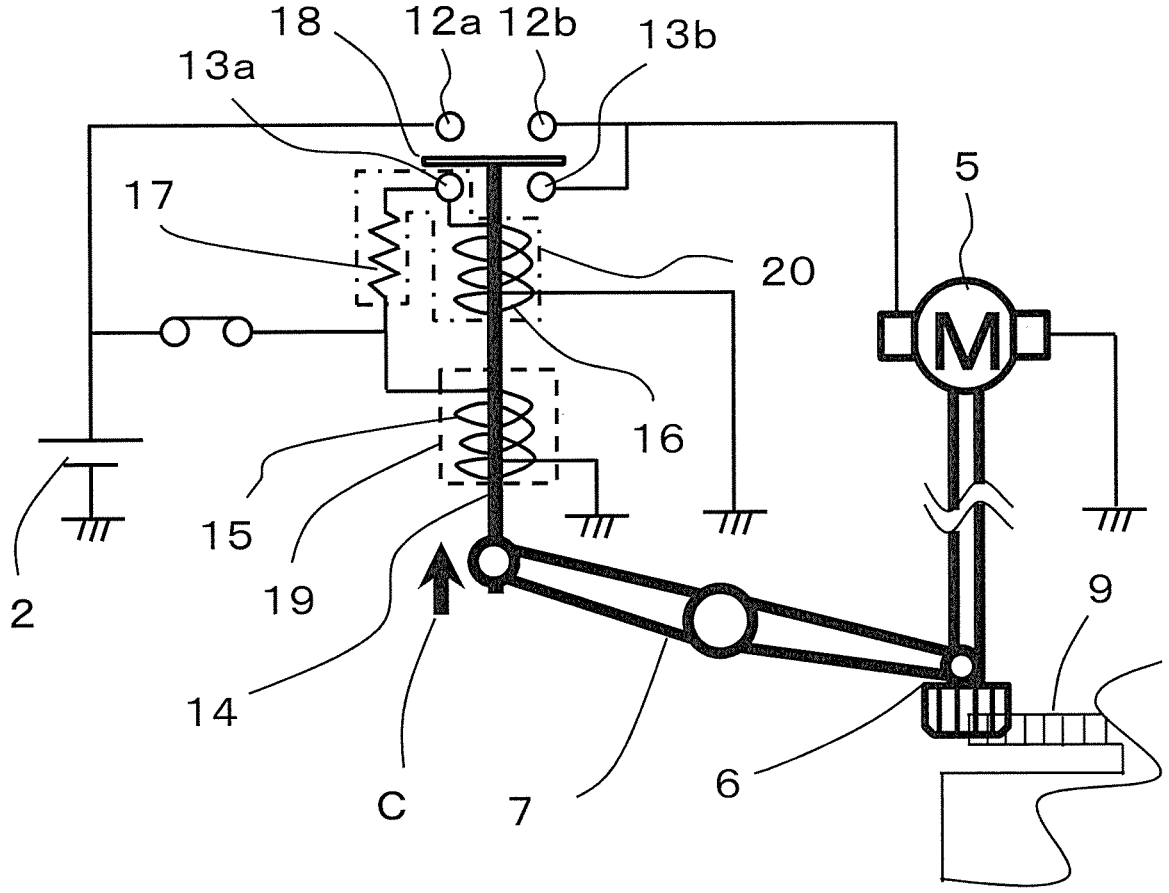
FIG. 3 is an explanatory diagram of a second operation stage in the starter of FIG. 1.

Next, a description is given on a second operation stage in which the pinion 6 is displaced from the contact position to the engaged position after the first operation stage. FIG. 3 is an explanatory diagram of the second operation stage in the starter 1 of FIG. 1. After the pinion 6 is fit with the ring gear 9 in the first operation stage, the movable iron core 14 engaged with the lever 7 is moved further to reach the movable contact 18, at which point the movable contact 18 is moved in a direction away from the pair of start-up electric contacts 13 to open the pair of start-up electric contacts 13. This cuts off the current flowing into the start-up electric circuit 11, which causes the start-up rotational force B of the motor 5 to cease to exist.

With the start-up electric contacts 13 being open, the current flowing in the auxiliary attracting and holding coil 16 is equal to a current flowing in the resistor 17, and has a value larger than the value of the current in the auxiliary attracting and holding coil 16 prior to the opening of the start-up electric contacts 13, although smaller than the value of the current flowing in the resistor 17 prior to the opening of the start-up electric contacts 13. This makes the magnetomotive force of the auxiliary attracting and holding coil 16 larger than that in the first operation stage. On the other hand, the current flowing in the primary attracting and holding coil 15 changes little and as large a magnetomotive force as that in the first operation stage is generated. Accordingly, the magnetomotive force of the auxiliary attracting and holding coil 16 contributes considerably to an attracting and holding force C with which the operation in the second operation stage is performed smoothly.

As described above, the current flowing in the resistor 17 is much smaller than that in the first operation stage. As a result, the amount of heat generated in the resistor 17 is reduced.

Figure 4:
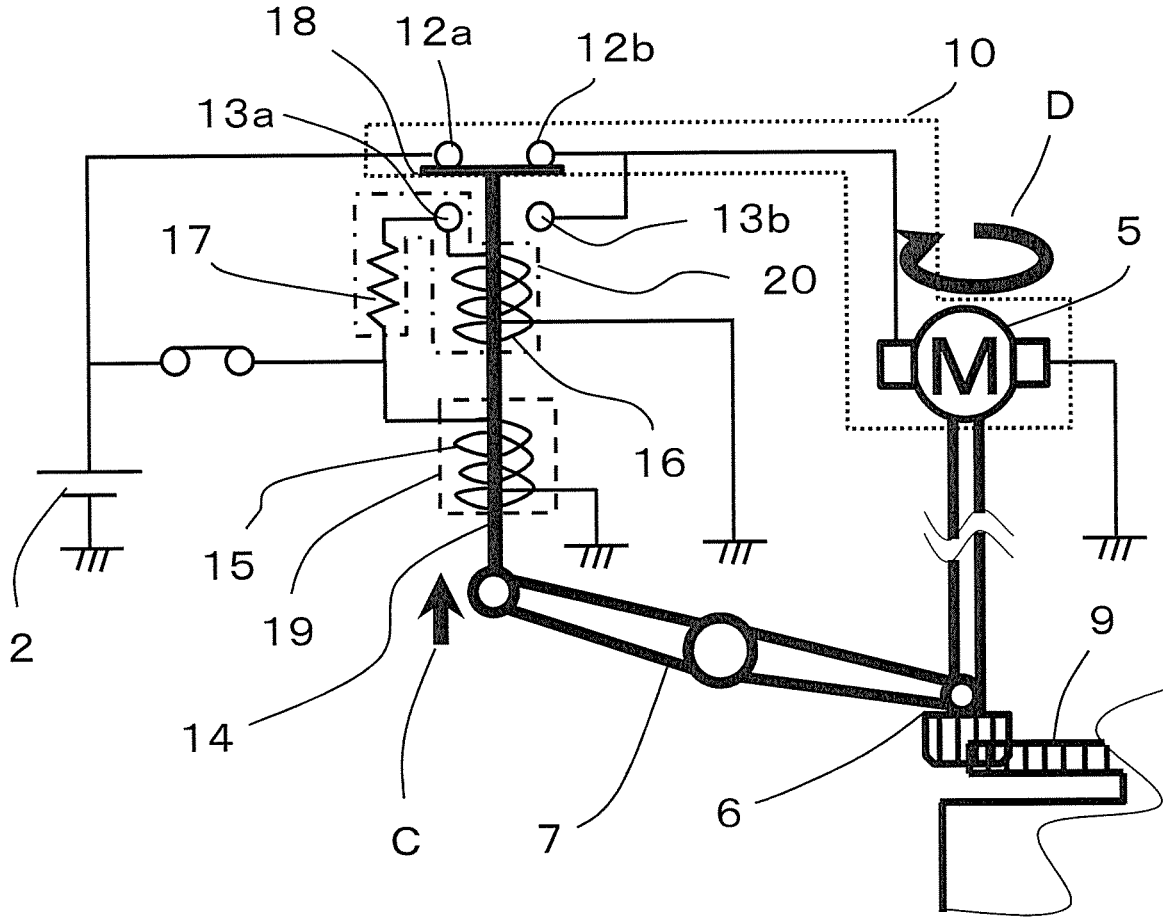
FIG. 4 is an explanatory diagram of a third operation stage in the starter of FIG. 1.

Next, a description is given on a third operation stage in which the main electric contacts 12 are switched on after the second operation stage to generate a main rotational force D in the motor 5, and the generation of the main rotational force D is maintained. FIG. 4 is an explanatory diagram of the third operation stage in the starter 1 of FIG. 1. After moving in a direction away from the start-up electric contacts 13 in the second operation stage, the movable contact 18 is moved further in the direction away from the start-up electric contacts 13 by the attracting and holding force C to come into contact with the pair of main electric contacts 12, thereby closing the pair of main electric contacts 12. This closes the main electric circuit 10, causing a current to flow from the battery 2 to the motor 5. Consequently, the main rotational force D with which the engine is driven is generated in the motor 5. Once the engine is started through the process described above, the starter 1 is no longer required to be in operation, and is stopped by opening the auxiliary relay 3.

As described above, the electromagnetic switch device 4 for a starter according to the first embodiment of the present invention includes: the pair of main electric contacts 12 included in the main electric circuit 10 to determine whether to open or close the main electric circuit 10 depending on electric connection/disconnection between the pair of main electric contacts 12; the pair of start-up electric contacts 13 included in the start-up electric circuit 11 to determine whether to open or close the start-up electric circuit 11 depending on electric connection/disconnection between the pair of start-up electric contacts 13; the movable iron core 14 configured to displace the pinion of the starter 1 between the separated position at which the pinion 6 is apart from the ring gear 9 of the engine 8 and the contact position at which the pinion 6 is brought into contact with the ring gear 9, and between the contact position and the engaged position at which the pinion 6 is engaged with the ring gear; the primary attracting and holding coil 15 provided around the movable iron core 14 and configured to generate a magnetomotive force; the resistor 17 provided to create a branch upstream of the primary attracting and holding coil 15 and electrically connected to the upstream start-up electric contact 13*a*; and the auxiliary attracting and holding coil 16, which is electrically connected to the upstream start-up electric contact 13*a*, provided around the movable iron core 14 coaxially with the primary attracting and holding coil 15, and is configured to generate a magnetomotive force. The start-up attractive force A is generated from the magnetomotive force of the primary attracting and holding coil 15 in response to a start-up signal to displace the pinion 6 from the separated position to the contact position with the movable iron core 14, and a current flowing in the resistor 17 generates the start-up rotational force B in the motor 5. After the pinion 6 is displaced from the separated position to the contact position, the start-up electric contacts 13 are electrically disconnected to cut off the current to the motor 5, which causes the start-up rotational force B to cease to exist, and the attraction and holding force C is generated from the magnetomotive force of the primary attracting and holding coil 15 and the magnetomotive force of the auxiliary attracting and holding coil 16 to displace the pinion 6 from the contact position to the engaged position. After the pinion 6 is displaced from the contact position to the engaged position, the main electric contacts 12 are electrically connected to resume electric connection to the motor 5, which generates the main rotational force D of the motor 5, and the attracting and holding force C is generated from the magnetomotive force of the primary attracting and holding coil 15 and the magnetomotive force of the auxiliary attracting and holding coil 16 to keep the pinion 6 at the engaged position with the movable iron core 14.

As described above, according to the electromagnetic switch device 4 for a starter of the first embodiment of the present invention, an impact force with which the pinion 6 bumps into the ring gear 9 is made smaller by reducing the start-up attractive force A, which is generated when the pinion 6 is displaced from the separated position to the contact position in the first operation stage of engagement operation, and the wearing of the ring gear 9 can accordingly be decreased.

In addition, the operation in the second operation stage is performed smoothly because the attracting and holding force C with which the pinion 6 is displaced from the contact position to the engaged position in the second operation stage can be made large. The operation in the second operation stage is performed smoothly also because the pinion 6 can be displaced from the contact position to the engaged position in the absence of the start-up rotational force B and the main rotational force D, which means that the pinion 6 can be displaced from the contact position to the engaged position without friction between surfaces of engaged teeth.

The attracting and holding force C generated in the third operation stage after the pinion 6 is displaced from the contact position to the engaged position can be made large as well, and the pinion 6 can accordingly be kept at the engaged position without fail.

Second Embodiment

Figure 5:
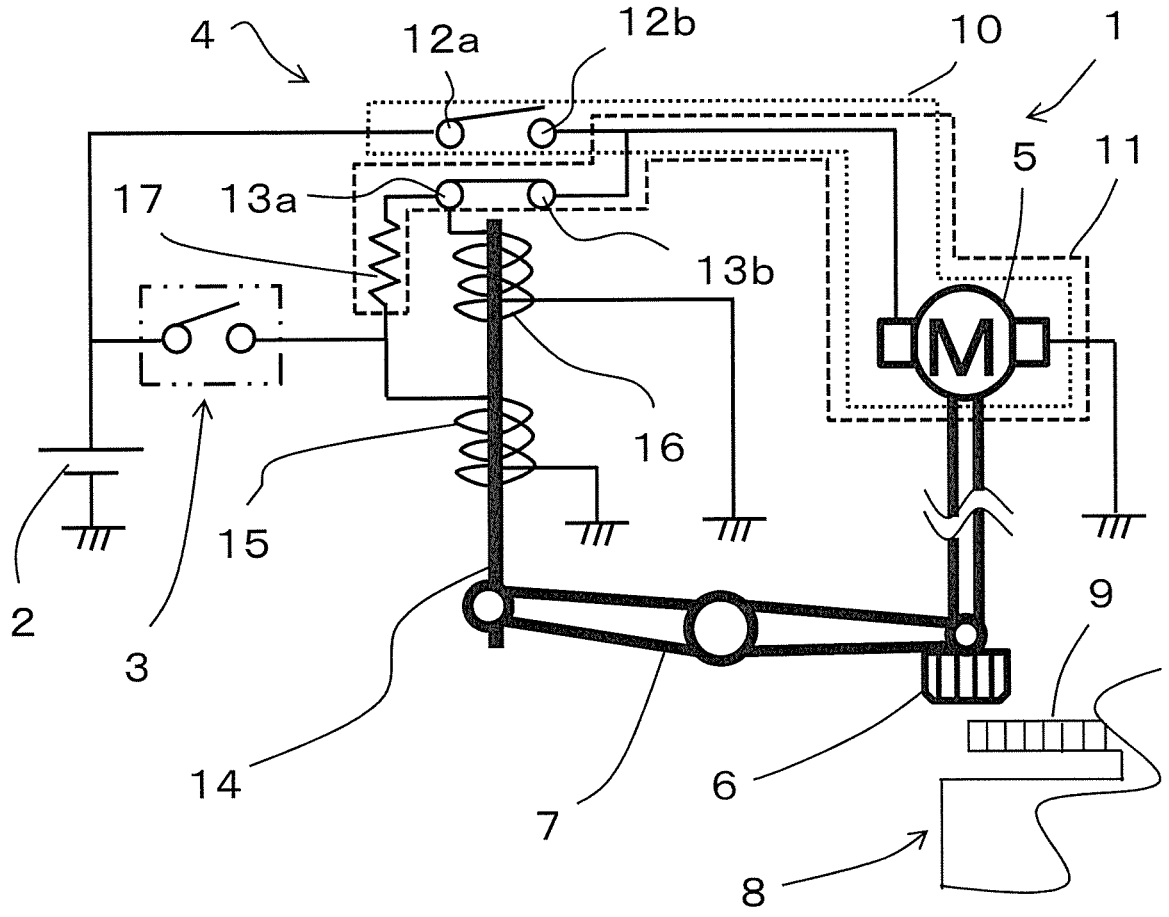
FIG. 5 is a diagram for illustrating a starter of a second embodiment of the present invention.

FIG. 5 is a diagram for illustrating a starter of a second embodiment of the present invention. The movable contact 18 is used in the first embodiment to switch between electric connection and disconnection of the pair of main electric contacts 12 to and from each other and to switch between electric connection and disconnection of the pair of start-up electric contacts 13 to and from each other. In the second embodiment, separate movable contacts are used to switch between electric connection and disconnection of the pair of main electric contacts 12 to and from each other and to switch between electric connection and disconnection of the pair of start-up electric contacts 13 to and from each other. The rest of the configuration of the second embodiment is the same as the first embodiment.

As described above, according to the electromagnetic switch device 4 for a starter of the second embodiment of the present invention, separate movable contacts are used to switch between electric connection and disconnection of the pair of main electric contacts 12 to and from each other and to switch between electric connection and disconnection of the pair of start-up electric contacts 13 to and from each other, and the same effects as those in the first embodiment can therefore be obtained.

Third Embodiment

Figure 6:
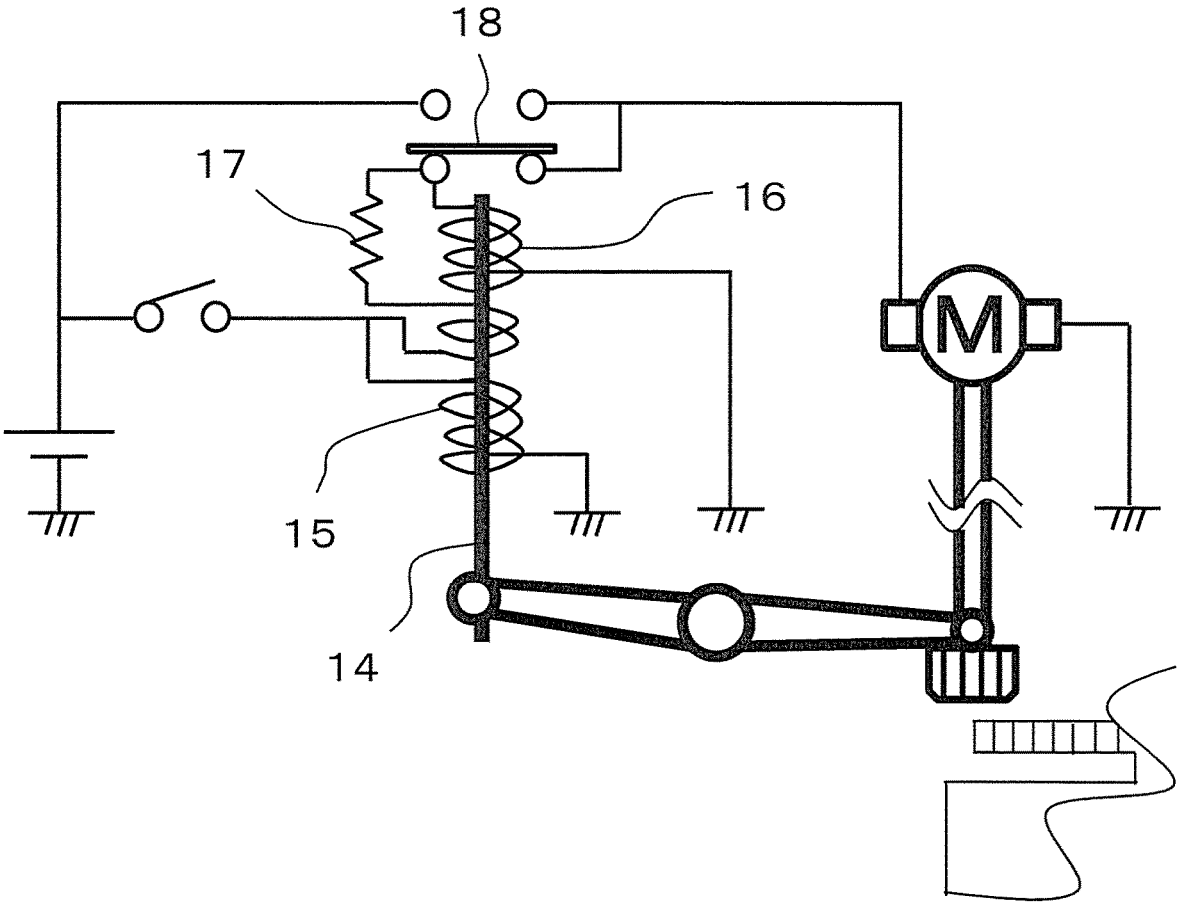
FIG. 6 is a diagram for illustrating a starter of a third embodiment of the present invention.

FIG. 6 is a diagram for illustrating a starter of a third embodiment of the present invention. The resistor 17 in the first embodiment is placed apart from the movable iron core 14. In the third embodiment, at least a part of the resistor 17 is wound around the movable iron core 14 coaxially with the primary attracting and holding coil 15 and the auxiliary attracting and holding coil 16. The rest of the configuration of the third embodiment is the same as the first embodiment or the second embodiment.

As described above, according to the electromagnetic switch device 4 for a starter of the third embodiment of the present invention, at least a part of the resistor 17 is wound around the movable iron core 14 coaxially with the primary attracting and holding coil 15 and the auxiliary attracting and holding coil 16, and a current flow in the part of the resistor 17 wound around the movable iron core 14 generates a magnetomotive force, which contributes to the start-up attractive force A and the attracting and holding force C. The primary attracting and holding coil 15 and the auxiliary attracting and holding coil 16 can thus be reduced in size, weight, and cost.

The invention claimed is:

1. An electromagnetic switch device for a starter, comprising:

a pair of main electric contacts included in a main electric circuit to determine whether to open or close the main electric circuit depending on electric connection/disconnection between the pair of main electric contacts, the main electric circuit being configured to allow a current to flow from a battery to a motor;

a pair of start-up electric contacts included in a start-up electric circuit to determine whether to open or close the start-up electric circuit depending on electric connection/disconnection between the pair of start-up electric contacts, the start-up electric circuit being configured to allow a current to flow from the battery to the motor;

a movable iron core configured to displace a pinion of a starter between a separated position, at which the pinion is apart from a ring gear of an engine, and a contact position, at which the pinion is brought into contact with the ring gear, and between the contact position and an engaged position, at which the pinion is engaged with the ring gear;

a primary attracting and holding coil provided around the movable iron core and configured to generate a magnetomotive force;

a resistor provided to create a branch upstream of the primary attracting and holding coil, and electrically connected to one of the pair of start-up electric contacts; and an auxiliary attracting and holding coil, which is electrically connected to the one of the pair of start-up electric contacts, provided around the movable iron core coaxially with the primary attracting and holding coil, and is configured to generate a magnetomotive force, wherein the pinion is displaced from the separated position to the contact position with the movable iron core and with the magnetomotive force of the primary attracting and holding coil in response to a start-up signal, and a current flowing in the resistor generates a start-up rotational force in the motor, wherein, after the pinion is displaced from the separated position to the contact position, the start-up electric contacts are electrically disconnected to cut off the current to the motor, and the pinion is displaced from the contact position to the engaged position with the movable iron core and with the magnetomotive force of the primary attracting and holding coil and the magnetomotive force of the auxiliary attracting and holding coil, and wherein, after the pinion is displaced from the contact position to the engaged position, the main electric contacts are electrically connected to resume electric connection to the motor, which generates a main rotational force of the motor, and the pinion is kept at the engaged position with the movable iron core and with the magnetomotive force of the primary attracting and holding coil and the magnetomotive force of the auxiliary attracting and holding coil.

2. An electromagnetic switch device for a starter according to claim 1, wherein switching between electric connection and disconnection of the pair of main electric contacts to and from each other and switching between electric connection and disconnection of the pair of start-up electric contacts to and from each other are conducted by displacing the movable iron core.

3. An electromagnetic switch device for a starter according to claim 2, wherein at least a part of the resistor is wound around the movable iron core coaxially with the primary attracting and holding coil and the auxiliary attracting and holding coil.

4. An electromagnetic switch device for a starter according to claim 1, wherein at least a part of the resistor is wound around the movable iron core coaxially with the primary attracting and holding coil and the auxiliary attracting and holding coil.

* * * * *